US011035284B2

(12) United States Patent
Murata et al.

(10) Patent No.: US 11,035,284 B2
(45) Date of Patent: Jun. 15, 2021

(54) PIPE STRUCTURE

(71) Applicant: Toyota Jidosha Kabushiki Kaisha, Toyota (JP)

(72) Inventors: Toshio Murata, Toyota (JP); Yoshikazu Shinpo, Nisshin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 12 days.

(21) Appl. No.: 16/503,871

(22) Filed: Jul. 5, 2019

(65) Prior Publication Data

US 2020/0018219 A1 Jan. 16, 2020

(30) Foreign Application Priority Data

Jul. 10, 2018 (JP) ..... JP2018-131084

(51) Int. Cl.

| | |
|---|---|
| ***F01N 13/14*** | (2010.01) |
| ***C23C 24/08*** | (2006.01) |
| ***F01N 13/08*** | (2010.01) |

(52) U.S. Cl.

CPC ..... *F01N 13/141* (2013.01); *C23C 24/085* (2013.01); *F01N 13/08* (2013.01); *F01N 2260/08* (2013.01); *F01N 2530/26* (2013.01)

(58) Field of Classification Search

CPC .. F16L 9/14; F16L 9/21; F01N 3/0233; F01N 13/141; C23C 24/085

USPC ..... 138/145, 146, 140, 137, 139; 428/36.91

See application file for complete search history.

(56) References Cited

U.S. PATENT DOCUMENTS

| | | | | |
|---|---|---|---|---|
| 4,097,353 | A * | 6/1978 | Kishida | G01N 27/4075 204/410 |
| 5,942,339 | A * | 8/1999 | Garcia | C23C 18/36 148/253 |
| 5,948,723 | A * | 9/1999 | Sung | B01J 35/0006 502/303 |
| 6,044,644 | A * | 4/2000 | Hu | B01J 23/58 60/302 |
| 2011/0073209 | A1 * | 3/2011 | Eguchi | F16L 51/027 138/121 |

FOREIGN PATENT DOCUMENTS

| | | |
|---|---|---|
| JP | H0871422 A | 3/1996 |

* cited by examiner

*Primary Examiner* — Patrick F Brinson

(74) *Attorney, Agent, or Firm* — Dinsmore & Shohl LLP

(57) ABSTRACT

A pipe structure includes a pipe disposed in a state of contact with the air, a fluid with a temperature of at least 100° C. flowing inside the pipe; and a coating material containing nickel oxide and coated onto an outer periphery portion of the pipe.

3 Claims, 2 Drawing Sheets

PIPE STRUCTURE

CROSS-REFERENCE TO RELATED APPLICATION

This application claims priority under 35 USC 119 from Japanese Patent Application No. 2018-131084 filed Jul. 10, 2018, the disclosure of which is incorporated by reference herein in its entirety.

BACKGROUND

Technical Field

The present disclosure relates to a pipe structure.

Related Art

Since heretofore, the use of a catalyst in which iridium, neodymium and nickel are together carried on a carrier formed of silicon carbide to clean exhaust gas from an internal combustion engine of a car or the like has been known (for example, see Japanese Patent Application Laid-Open (JP-A) No. H8-71422).

SUMMARY

However, although this catalyst may clean exhaust gas, it may not remove hazardous components in air (such as ozone).

Accordingly, the present disclosure provides a pipe structure that may remove ozone from the air in a vicinity of a pipe.

In order to achieve the object described above, a pipe structure according to a first aspect of the present disclosure includes: a pipe disposed in a state of contact with the air, a fluid with a temperature of at least 100° C. flowing inside the pipe; and a coating material that contains nickel oxide and that is coated onto an outer periphery portion of the pipe.

According to the pipe structure of the first aspect, the nickel oxide, that is contained in the coating material coated onto the outer periphery portion of the pipe, is heated by the fluid with a temperature of 100° C. or more flowing inside the pipe that is disposed in a state of contact with the atmosphere. Consequently, ozone in the air in the vicinity of the pipe is removed by catalytic action of the nickel oxide.

In a pipe structure according to a second aspect of the present disclosure, in the pipe structure of the first aspect, a base material of the coating material is a porous material.

According to the pipe structure of the second aspect, the base material of the coating material is a porous material. Therefore, a contact surface area between the air and the nickel oxide is increased, and effectiveness of removal of ozone from the air in the vicinity of the pipe is improved.

In a pipe structure according to a third aspect of the present disclosure, in the pipe structure of the first aspect or the second aspect, the pipe is an exhaust pipe provided at a vehicle.

According to the pipe structure of the third aspect, the pipe serves as an exhaust pipe that is provided at a vehicle. Accordingly, ozone in the air in a vicinity of the exhaust pipe is removed during running of the vehicle.

In a pipe structure according to a fourth aspect of the present disclosure, in the pipe structure of the third aspect, the coating material is coated onto a surface of a sub-muffler that structures a portion of the exhaust pipe.

According to the pipe structure of the fourth aspect, the coating material is coated onto the surface of the sub-muffler that constitutes a portion of the exhaust pipe. This sub-muffler is a high-temperature region with a temperature of 100° C. or more. Therefore, the catalytic action of the nickel oxide is facilitated, and ozone in the air in the vicinity of the exhaust pipe is removed efficiently.

According to the pipe structure of the first aspect, ozone in the air in a vicinity of the pipe may be removed.

According to the pipe structure of the second aspect, the effectiveness of removal of the ozone in the air in the vicinity of the exhaust pipe may be improved.

According to the pipe structure of the third aspect, the ozone in the air in the vicinity of the exhaust pipe may be removed during running of the vehicle.

According to the pipe structure of the fourth aspect, the ozone in the air in the vicinity of the exhaust pipe may be removed efficiently.

DETAILED DESCRIPTION

Herebelow, an exemplary embodiment of the present disclosure is described in detail in accordance with the drawings.

A pipe structure 10 according to the present exemplary embodiment can be excellently employed at an exhaust pipe 14 (of a vehicle), which serves as an example of a pipe 12. Below, descriptions are given using the exhaust pipe 14 of the vehicle as an example. For convenience of description, the arrow UP shown in FIG. 1 indicates a vehicle upper direction and the arrow FR indicates a vehicle front direction.

Figure 1:
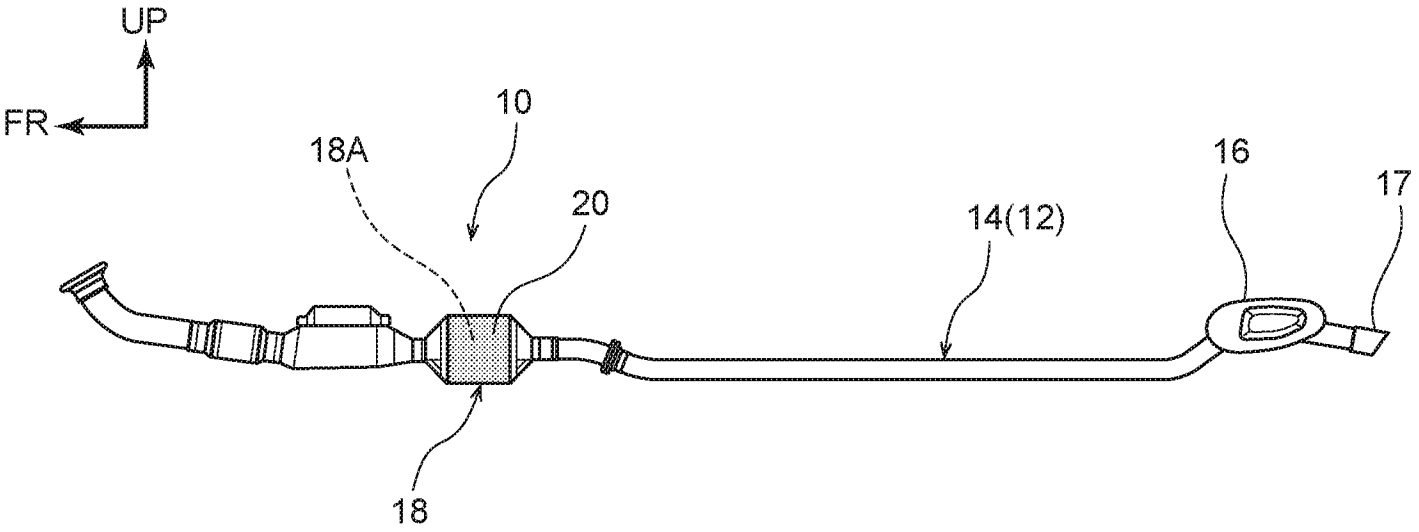
FIG. 1 is a side view showing an exhaust pipe of a vehicle at which a pipe structure according to a present exemplary embodiment is employed.

As shown in FIG. 1, the exhaust pipe 14 is provided at a lower portion of the vehicle (which is not shown in the drawings). The exhaust pipe 14 extends toward the vehicle rear side from an engine (not shown in the drawings) disposed at the vehicle front side. The exhaust pipe 14 is disposed in a state of contact with the atmosphere. A muffler 16 that constitutes a portion of the exhaust pipe 14 is connected in fluid communication with a rear end portion of the exhaust pipe 14.

In a side view seen in the vehicle width direction, the muffler 16 is formed in a substantially elliptical shape with an axial direction in the vehicle width direction. The rear end portion of the exhaust pipe 14 is connected in fluid communication with a substantially central portion in the vehicle width direction of a front end portion of the muffler 16. A muffler cutter 17 extends toward the vehicle body rear side from a right side portion of the muffler 16.

A sub-muffler 18 that constitutes another portion of the exhaust pipe 14 is connected in fluid communication at an intermediate portion of the exhaust pipe 14. The sub-muffler 18 is a two-layer tube structure formed with a larger diameter than other regions of the exhaust pipe 14. The sub-muffler 18 acts as a high-temperature region inside which exhaust gases flow as a fluid with a temperature of 100° C. or more.

A coating material 20 containing nickel oxide is coated onto a surface (a whole outer periphery face) 18A of the sub-muffler 18. Nickel oxide is an inorganic compound that functions as a catalyst that decomposes and removes ozone when heated to 100° C. or more. In some embodiments, a base material (a material that serves as a base containing the nickel oxide) of the coating material 20 is a porous material.

Now, operations of the pipe member 10 structured as described above are described.

As described above, the coating material 20 containing nickel oxide is coated onto the surface 18A of the sub-muffler 18. Hence, during running of the vehicle, the surface 18A of the sub-muffler 18 is heated by exhaust gas with a temperature of 100° C. or more flowing inside the sub-muffler 18. Thus, the nickel oxide is heated by the exhaust gas with a temperature of 100° C. or more. Consequently, during running of the vehicle, ozone in the air in the vicinity of the sub-muffler 18 (the exhaust pipe 14) may be decomposed and removed by the catalytic action of the nickel oxide.

Figure 2:
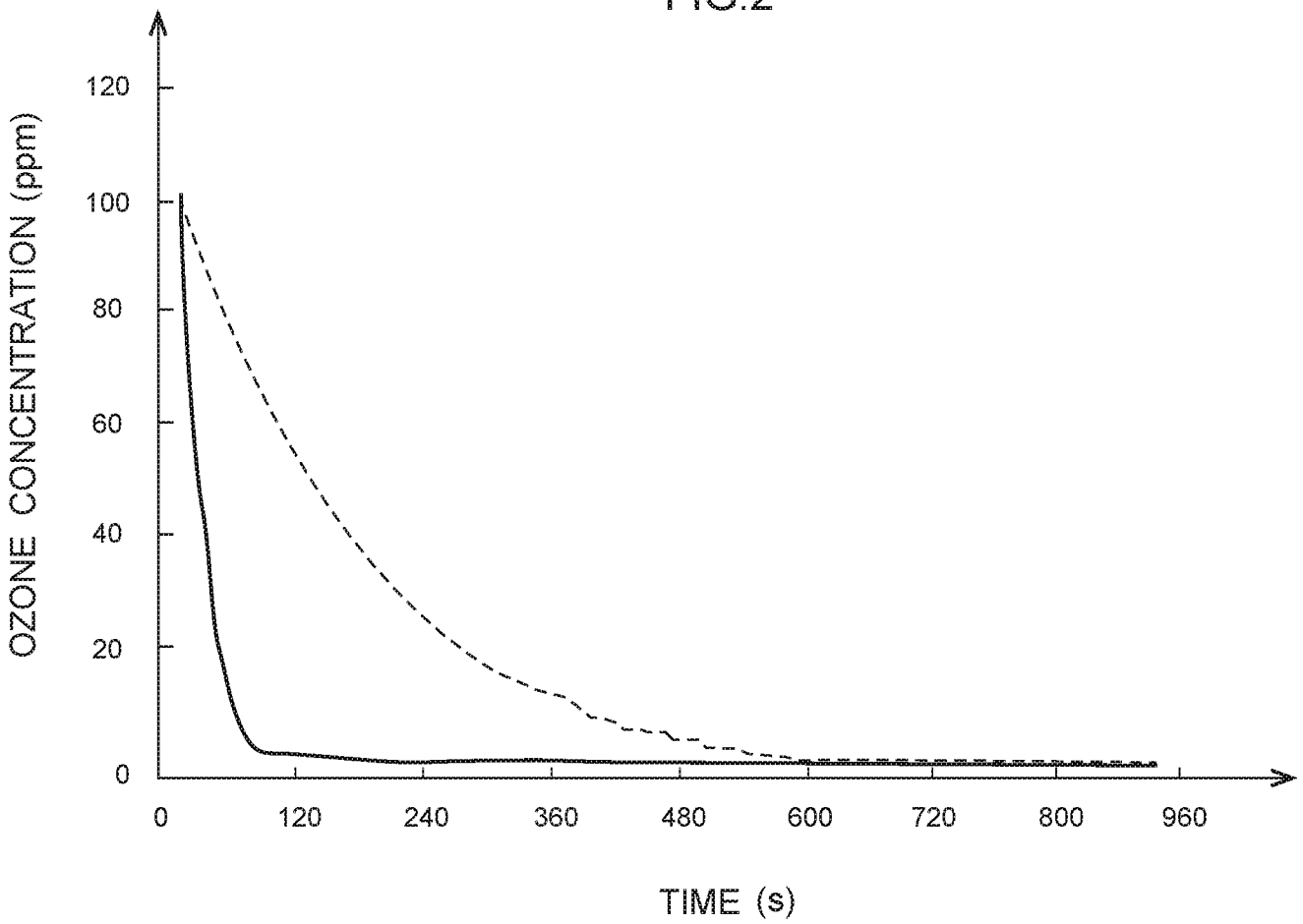
FIG. 2 is a graph showing a comparison of ozone concentrations over time between a vicinity of the exhaust pipe at which the pipe structure according to the present exemplary embodiment is employed and a vicinity of an exhaust pipe at which the pipe structure is not employed.

Test results are shown in FIG. 2. The graph depicted as a broken line in FIG. 2 represents a situation in which the coating material 20 is not coated onto the sub-muffler 18. The graph depicted as a solid line in FIG. 2 represents a situation in which the coating material 20 is coated onto the sub-muffler 18. Natural decomposition of ozone is facilitated by heating. Consequently, as shown by the broken line in FIG. 2, even when the coating material 20 (nickel oxide) has not been coated, ozone in the air in the vicinity of the sub-muffler 18 (the exhaust pipe 14) naturally decomposes and is removed as time passes (as around 600 seconds passes).

However, as shown by the solid line in FIG. 2, when the coating material 20 (nickel oxide) has been coated onto the sub-muffler 18, ozone in the air in the vicinity of the sub-muffler 18 (the exhaust pipe 14) may be decomposed and removed in a shorter time, around 100 seconds, which is about six times faster than in the situation in which the coating material 20 (nickel oxide) has not been coated onto the sub-muffler 18. In particular, if the base material of the coating material 20 is a porous material, because a contact surface area between the nickel oxide and the air is increased, the effectiveness of removal of ozone from the air in the vicinity of the sub-muffler 18 (the exhaust pipe 14) may be improved.

As described above, the sub-muffler 18 acts as a high-temperature region with a temperature of 100° C. or more. Therefore, when the coating material 20 (nickel oxide) is coated onto the sub-muffler 18, the catalytic action of the nickel oxide may be facilitated compared to a situation in which the coating material 20 (nickel oxide) is coated onto a region of the exhaust pipe 14 other than the sub-muffler 18. Thus, ozone in the air in the vicinity of the sub-muffler 18 (the exhaust pipe 14) may be removed efficiently.

Hereabove, the pipe structure 10 according to the present exemplary embodiment has been described in accordance with the attached drawings. However, the pipe structure 10 according to the present exemplary embodiment is not limited to the illustrated structure; suitable design modifications may be applied within a scope not departing from the scope of the present disclosure. For example, a region onto which the coating material 20 containing nickel oxide is coated is not limited to the sub-muffler 18 and may be an alternative region of the exhaust pipe 14, although removing ozone efficiently may then be more difficult.

Further, the base material of the coating material 20 is not limited to porous materials. Further still, the pipe structure 10 according to the present exemplary embodiment is not limited to a structure that is employed at the exhaust pipe 14 (the sub-muffler 18) of a vehicle. The pipe structure 10 according to the present exemplary embodiment may be employed at any pipe 12, provided a high-temperature fluid with a temperature of 100° C. or more flows in the pipe 12 and provided a region onto which the coating material 20 may be coated is formed at an outer periphery portion of the pipe 12.

What is claimed is:

1. A pipe structure comprising:

a pipe disposed in a state of contact with air, a fluid with a temperature of at least 100° C. flowing inside the pipe; and a coating material containing nickel oxide and coated onto an outer periphery portion of the pipe, a base material of the coating material is a porous material.

2. The pipe structure according to claim 1, wherein the pipe is an exhaust pipe provided at a vehicle.

3. The pipe structure according to claim 2, wherein the coating material is coated onto a surface of a sub-muffler that structures a portion of the exhaust pipe.

* * * * *